US005332198A

United States Patent [19]

Yeh et al.

[11] Patent Number: 5,332,198

[45] Date of Patent: Jul. 26, 1994

[54] METHOD FOR PRODUCING RAPIDLY-SOLIDIFIED FLAKE-LIKE METAL POWDER AND APPARATUS FOR PRODUCING THE SAME

[75] Inventors: Jien-Wei Yeh; Kuo-Shung Liu; Kuang-Yuan Shue; Yung-Chiun Ho, all of Hsinchu, Taiwan

[73] Assignee: National Science Council, Taipei, Taiwan

[21] Appl. No.: 971,075

[22] Filed: Nov. 3, 1992

Related U.S. Application Data

[62] Division of Ser. No. 847,593, Mar. 5, 1992, Pat. No. 5,259,861.

[51] Int. Cl.[5] ..... B22F 9/10

[52] U.S. Cl. ..... 266/202; 266/204; 164/437

[58] Field of Search ..... 266/202, 204; 425/8; 164/437

[56] References Cited

U.S. PATENT DOCUMENTS

| | | | |
|---|---|---|---|
| 3,761,548 | 9/1973 | Winter et al. | 425/8 |
| 4,259,270 | 3/1981 | Winter et al. | 264/8 |
| 4,310,292 | 1/1982 | Carlson et al. | 425/8 |
| 4,375,440 | 3/1983 | Thompson | 425/8 |
| 4,435,342 | 3/1984 | Wentzel | 264/8 |
| 5,180,539 | 1/1993 | Yoshino et al. | 266/202 |
| 5,196,049 | 3/1993 | Coombs et al. | 266/202 |

*Primary Examiner*—George Wyszomierski
*Attorney, Agent, or Firm*—Fish & Richardson

[57] ABSTRACT

Disclosed is a method and an apparatus for producing rapidly-solidified flake particles, which combines centrifugal atomization with metal substrate cooling. A stream of molten metal is disintegrated centrifugally into droplets by a rotating disk. Then the molten droplets are solidified as flake particles as soon as impinging upon the annular planar surface of a cooled rotating concave disk. The solidified flake particles are subsequently departed from the annular planar surface by the centrifugal force and collected in a chamber.

9 Claims, 4 Drawing Sheets

METHOD FOR PRODUCING RAPIDLY-SOLIDIFIED FLAKE-LIKE METAL POWDER AND APPARATUS FOR PRODUCING THE SAME

This is a divisional of copending application Ser. No. 07/847,593 filed Mar. 5, 1992, now U.S. Pat. No. 5,259,861.

FIELD OF THE INVENTION

The present invention relates to a method and an apparatus for producing rapidly-solidified flake particulate directly from the melt. More particularly, the invention concerns with a method and an apparatus capable of pouring a stream of molten metal onto a rotating member so as to disintegrate the molten metal into droplets, and subsequently solidifying the liquid droplets as flake particles at high cooling rate by impinging the liquid droplets onto a cooled rotating metal substrate. The solidified flake particles are then departed from the rotating metal substrate by a centrifugal force and collected in a chamber.

BACKGROUND OF THE INVENTION

Since Dr. Duwez invented Splat Cooling process in 1960, rapid solidification technique has become a newly developed field in metallurgical engineering and a new route for promoting mechanical and physical properties of different kinds of alloys. The rapid solidification technique has the merits in refining of microstructure, extension of solubility limit, producing homogeneous concentration distribution, and formation of amorphous phase. Such characteristics give more freedom to alloy design, and achieve better mechanical and physical properties than conventional processes can ever do.

The purpose of rapidly-solidified powder metallurgy is to solidify molten metal at a high cooling rate (higher than $10^2$ K/sec) to form grain-like, flake-like, or strip-like metal particles. The metal particles are then pressed, sintered, and hot worked to produce final products. According to relevant researches, the quality of the rapidly-solidified powder has a great effect on the mechanical properties of the alloy products. Therefore, the manufacturing process of the rapidly-solidified powder is the very decisive step in the whole-process.

Many methods of producing rapidly-solidified powder have been developed. Basically, for achieving the highest cooling rate, each method needs to cause at least one dimension of the powder products as small as possible, so as to transfer heat to a cooling medium as soon as possible.

For example, the air atomization method utilizes air atomizing and air cooling. The powder product is sphere-like, with a cooling rate at about $10^{2-3}$ K/sec. Since the kinetic energy is mostly used in accelerating the molten metal, the energy used in atomizing is quite low, only about 2% to 4%.

Another example is the Alcoa Spray method developed by American Aluminum company (ALCOA), which uses air atomization and metal substrate cooling. Molten metal is atomized by air, and then sprayed upon the surface of a water cooled roller which rotates rapidly. Metal flakes attached on the roller are stripped off by brushes and gathered into a collector. The cooling rate is up to about $10^5$ K/sec. The flakes are disk-like, but often unflatten and overlapped. Similarly, the momentum transfer efficiency of air atomization used in this method is low.

Rapid Solidification Rate (RSR) technology developed by Pratt & Whitney Co., U.S. Pat. No. 4,078,873 and U.S. Pat. No. 4,343,750 represent utilize centrifugal atomization and helium cooling. Molten metal flows through a funnel onto a disk rotating at a high speed (about 24000 rpm). By centrifugal force, it is accelerated radially, and then atomized into drops after leaving the disk. The droplets are rapidly cooled by circulating helium atmosphere, and solidify to form sphere-like powder. The atomization efficiency of RSR is relatively high. However, the cooling rate of RSR is about $10^5$ K/sec. The RSR is expensive because it uses helium cooling.

SUMMARY OF THE INVENTION

The major object of the present invention is to provide a method for producing rapidly-solidified flake-like metal powder.

Another object of the present invention is to provide a method for producing rapidly-solidified flake-like metal powder, which has a relatively high efficiency of atomization.

Another object of the present invention is to provide a method for producing rapidly-solidified flake-like metal powder, which has a relatively high cooling rate.

Another object of the present invention is to provide a method for producing rapidly-solidified flake-like metal powder, with a relatively low cost.

The final object of the present invention is to provide an apparatus for producing this rapidly-solidified flake-like metal powder.

The present invention is characterized in a combination process of centrifugal atomization and metal substrate cooling. In other words, the present invention utilizes a high speed centrifugal atomizing disk to improve the atomization efficiency, and a rotating metal substrate to improve the cooling rate. The metal substrate is coaxially arranged below the atomizing disk, and rotates at a speed ranging from 1000 rpm to 3000 rpm. Its shape is like a dish. The upper surface of the metal substrate is concave, where the edge of the metal substrate has an angle with the horizontal plane at about 10° to 30° to cover the flying path of molten metal droplets. The metal substrate is made by materials having a high thermal conductivity, like copper, and cooled by jetting water on the bottom surface. Therefore, when molten metal droplets collide with the cooling substrate, they spread to form thin and long films, at the same time the latent heat of the molten metal droplets could be transferred to the cooling substrate fast for achieving the highest cooling rate.

The producing method according to the present invention includes the following steps: (1) providing a rotating dish-like metal substrate which has a concave upper surface; (2) disintegrating the molten metal as liquid droplets outwardly toward the inclined surface of the cooling substrate, for solidifying the liquid droplets into metal particles. The metal particles are forced to leave said cooling substrate by centrifugal force; and (3) collecting the solidified metal particles.

The apparatus for producing rapidly-solidified powder according to the present invention is composed of: (a) means for melting metal; (b) a first rotating disk for atomizing molten metal; (c) a second rotating disk having a concave upper surface surrounding said first rotating disk for splat-cooling; (d) means for guiding the molten metal onto said first rotating disk; and (e) means for collecting said solidified powder.

The further scope of applicability of the present invention will become apparent from the detailed description given hereinafter. However, it should be understood that the detailed description and specific examples described herein, while indicating preferred embodiments of the invention, are given by way of illustration only, since various changes and modifications within the spirit and scope of the invention will become apparent to those skilled in the art from this detailed description.

BRIEF DESCRIPTION OF THE FIGURES

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENT

Figure 1:
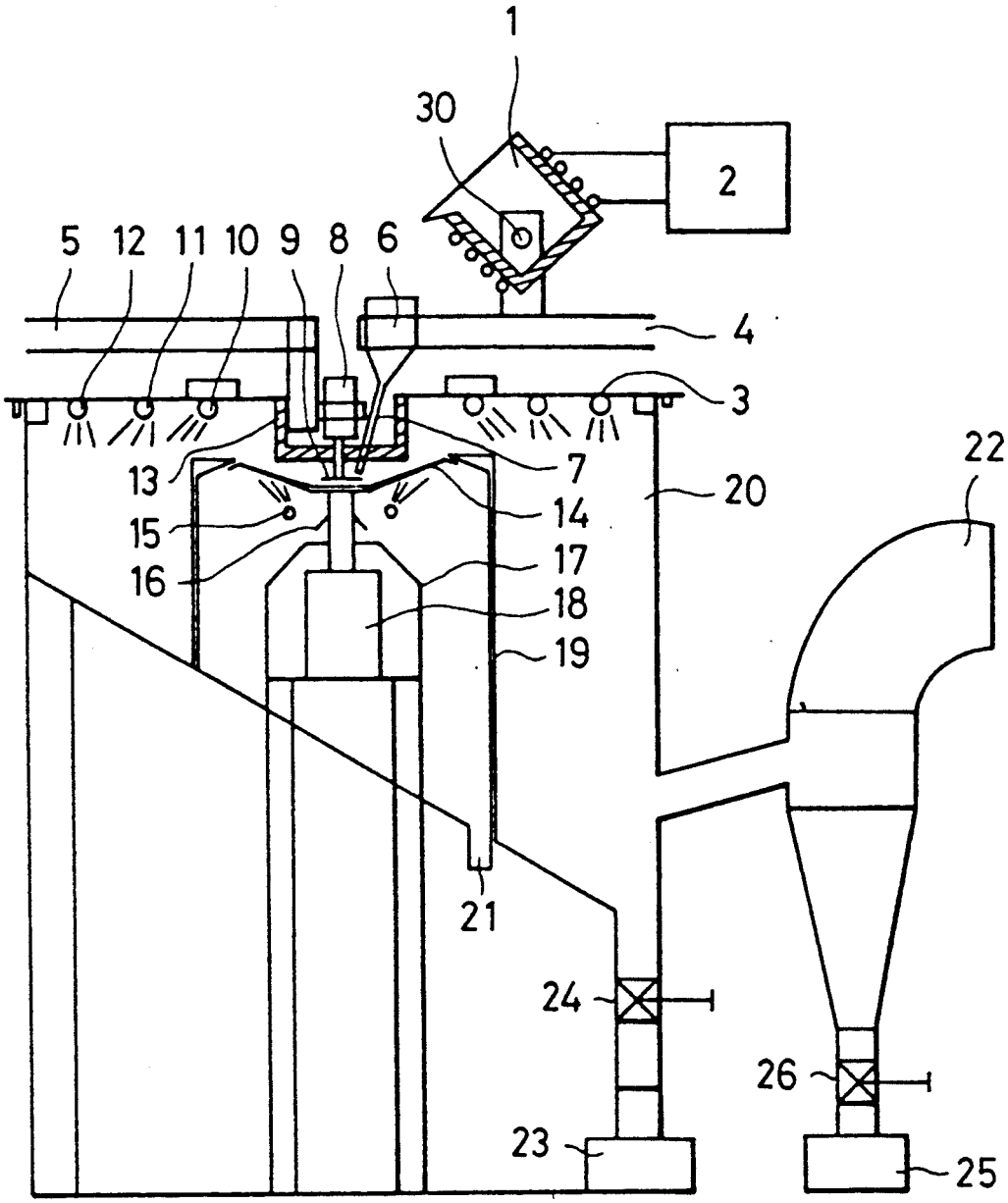
FIG. 1 is a schematic diagram showing all equipments of the present invention.
Figure 2:
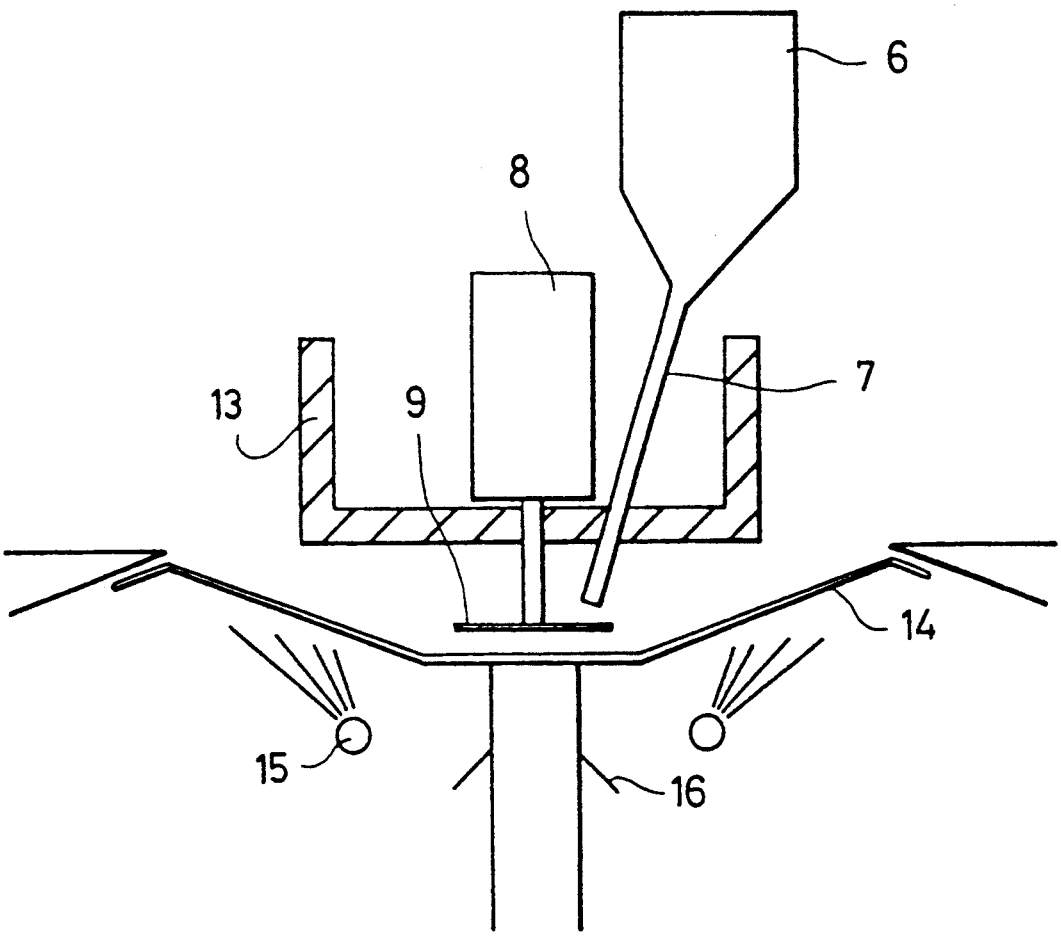
FIG. 2 is a partly enlarged schematic view showing the relationship between the atomizing disk and the cooling substrate.
Figure 3:
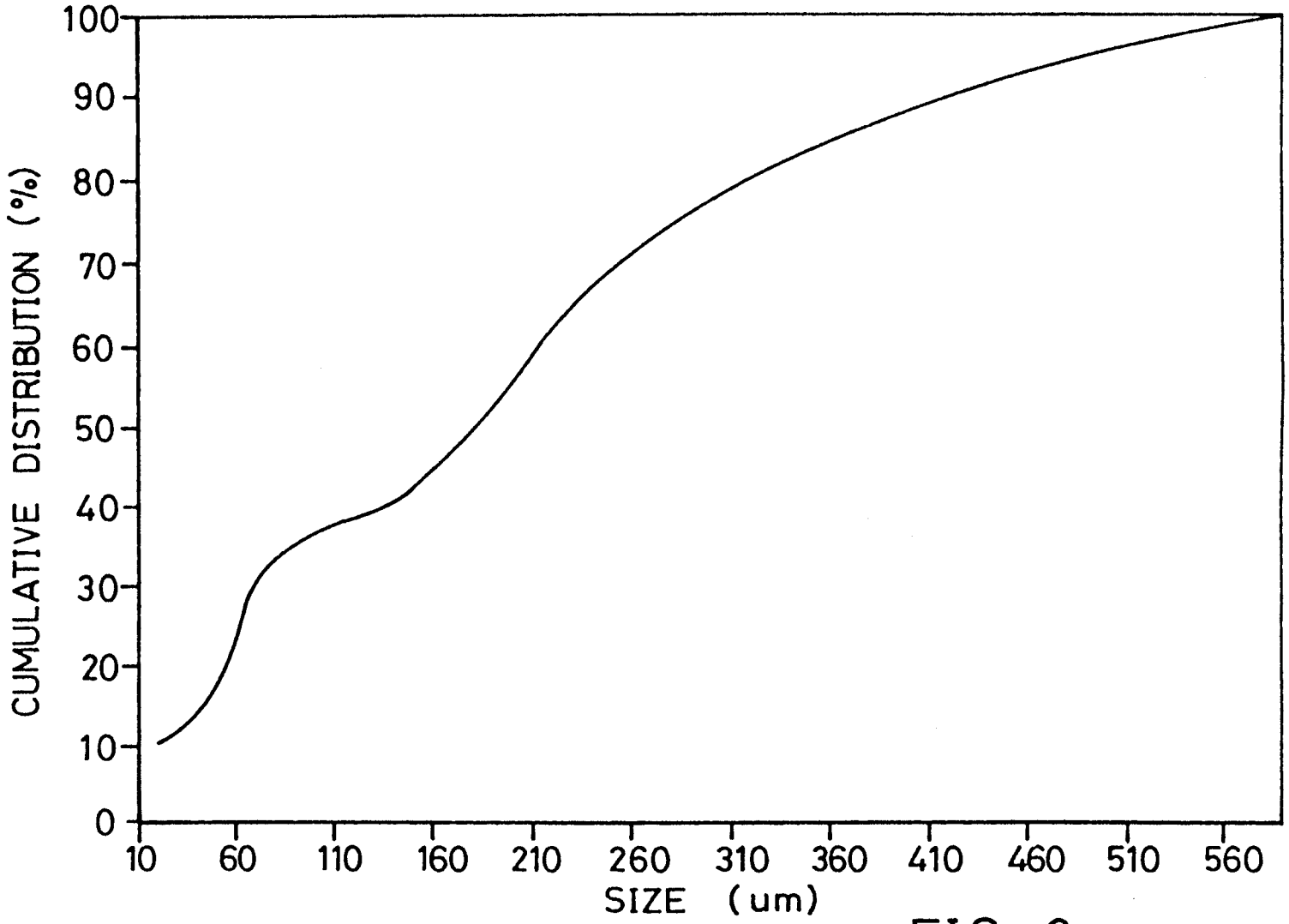
FIG. 3 shows the size distribution of the metal powder produced by the method according to the present invention.
Figure 4:
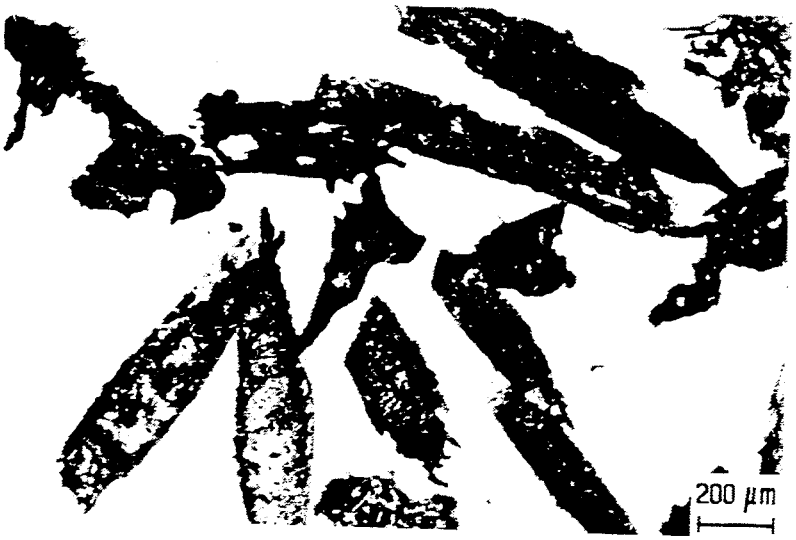
FIG. 4 shows the rapidly solidified aluminum flake particles produced by the method according to the present invention.

Please refer to FIGS. 1 and 2. By resistance heating or induction heating or arc, raw alloy material is molten in melting furnace 1 in vacuum or protective atmosphere as required. Power supply 2 supplies the energy required for the melting. Melting furnace 1 is supported by supporting means 4. Supporting means 4 is provided with a rotating means 30. Melting furnace 1 can be inclined by rotating means 30 in order to pour the melt into a funnel crucible 6. Melt flows through a conduit 7 and then onto a atomizing disk 9, where melt are atomized by centrifugal force. Funnel crucible 6 is supported by supporting means 4. Atomizing disk 9 is driven by a motor 8 which is an electric motor or an air motor at a rotating speed ranging from 3000 rpm to 20000 rpm, depending on the kind of the alloy and the required size of powder. Motor 8 is fixed on trestle 5. Atomizing disk 9 can be either plate-like or cup-like, and its diameter may range from 7 cm to 20 cm. Funnel crucible 6 and motor 8 are isolated from the collecting chamber 20 by a heat-resistant cup-like tube 13. A splat-cooling rotating substrate 14 is below the atomizing disk 9. Atomized metal particles collide the splat-cooling substrate 14, and are cooled instantly when the particles spread on the inclined surface of the splat-cooling substrate 14. Splat-cooling substrate 14 is dish-like and tapered at an angle ranging from 10° to 30°. If the angle is too small, the splat-cooling effect will be reduced. If the angle is too large, the flake-like powder can hardly escape from the splat-cooling substrate 14, and then would pile on the splat-cooling substrate 14. The splat-cooling substrate 14 is cooled by cooling water ejected from a circular pipe below 15. The splat-cooling disk is driven by an electric motor 18 at a speed ranging from 500 rpm to 3000 rpm. Electric motor 18 is disposed in a housing 17. A flange 16 is mounted on the shaft of the electric motor 18, preventing water from damaging the bearing of the motor 18. The cooling water is isolated by a cylindrical case 19, to prevent water from polluting the alloy powder. Cooling water exits from an outlet 21. Additionally, for preventing the powder from piling at the corners and for reducing the dimension of the collecting room 20, the cap 3 of the collecting room 20 is provided with circular gas pipes 11. The splat-cooled alloy powder is spilled into a collecting room 20 by centrifugal force. Gas is ejected from gas pipes 11 for deflecting the powder, therefore the powder will fall down rapidly. Larger powder will fall down into a first collector 23. Smaller powder will be sucked into a cyclone separator 22 and collected in a second collector 25.

Splat-cooling substrate 14 is made by materials having high heat transfer rate, like copper. Atomizing disk 9 and splat-cooling substrate 14 can move vertically along their central axis, for adjusting the position where melt droplets collide the splat-cooling disk 14, in order to improve the cooling rate. Under normal conditions, the atomizing disk 9 is higher than the splat-cooling disk 14 at about 1 cm to 8 cm.

Several experiments are discussed hereinbelow to illustrate the effect of the present invention.

EXPERIMENT 1

Pure aluminum is molten in the melting furnace at 750° C., and poured into the funnel crucible at 1500 g/min. Melt flows onto the atomizing disk rotating at 15000 rpm, and then droplets are splat-cooled on the splat-cooling substrate which rotates at 2000 rpm. The powder is flake-like. The size of the flakes distributes between −14 mesh and +325 mesh. The thickness of the flakes ranges from 5 μm to 30 μm. The characteristic size of microstructural feature is under 1 μm. The cooling rate is higher than $10^6$ K/sec.

EXPERIMENT 2

Figure 5:
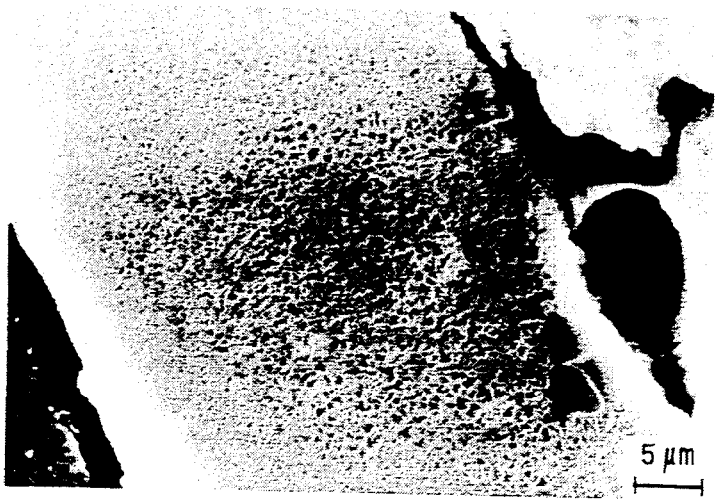
FIG. 5 shows the microstructure of rapidly solidified Al-12Si alloy flake made by the method according to the present invention.

Al-12%Si alloy is molten at 780° C. and poured into the funnel crucible at 1200 g/min. The atomizing disk rotates at 15000 rpm. The splat-cooling substrate rotates at 2000 rpm. Flake-like Al-12%Si alloy powder is obtained. The size of the flakes distributes between −14 mesh and +325 mesh. The microstructure of the powder is finer than conventional made powder, as shown in FIG. 5. Cooling rate is higher than $10^6$ K/sec.

EXPERIMENT 3

Fe-20%B alloy is molten in a quartz crucible under protective atmosphere at about 1350° C., and poured into the funnel crucible by pressure. The atomizing disk rotates at 20000 rpm. The splat-cooling substrate rotates at 2000 rpm. Flake-like Fe-20%B alloy powder is obtained. The structure of the flake is amorphous.

while the invention has been described by way of example and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. An apparatus for producing metal flake particles from molten metal, comprising:

(a) means for melting metal;

(b) a first rotating disk for atomizing molten metal;

(c) a second rotating disk having an annular planar upper surface surrounding said first rotating disk for splat cooling;

(d) a first rotating means for driving said first rotating disk, and an independent, second rotating means for driving said second rotating disk independently with respect to said first rotating disk;

(e) means for guiding the molten metal onto said first rotating disk positioned to cause said molten metal to disintegrate into molten droplets on the periphery of the first disk;

(f) means for impinging said molten droplets onto said annular planar surface in a manner to cause each of said molten droplets to be converted into a liquid film on said annular planar surface;

(g) means for maintaining said annular planar surface at a temperature substantially lower than that of said molten metal to cause said liquid film to solidify on the annular planar surface as a flake particle;

(h) means for applying a centrifugal force to each said flake particle in a manner to force the flake particles to leave said annular planar surface; and (i) means for collecting said flake particles.

2. An apparatus for producing metal flake particles as claimed in claim 1, wherein said second rotating disk is made of materials having high thermal conductivity.

3. An apparatus for producing metal flake particles as claimed in claim 1, wherein the edge of the second rotating disk has an angle with the horizontal plane of about 10° to 30°.

4. An apparatus for producing metal flake particles as claimed in claim 1 further comprising means for rotating said independent second rotating disk at a speed ranging from 500 rpm to 3000 rpm.

5. An apparatus for producing metal flake particles as claimed in claim 1 further comprising means for rotating said first rotating disk at a speed ranging from 3000 rpm to 20000 rpm.

6. An apparatus for producing metal flake particles as claimed in claim 1, wherein said guiding means is a funnel crucible.

7. An apparatus for producing metal flake particles as claimed in claim 1, wherein said collecting means is a chamber in combination with a cyclone separator.

8. An apparatus for producing metal flake particles as claimed in claim 1 wherein said means for maintaining the annular planar surface at a temperature substantially lower than that of said molten metal comprises a device for spraying water against a surface of said second disk opposite said annular planar surface and a column chamber through which said water can flow freely.

9. An apparatus for producing metal flake particles as claimed in claim 8 wherein said second rotating disk has a rim positioned to prevent said water from flowing out of said column chamber.

* * * * *